United States Patent [19]

Kluge

[11] Patent Number: 5,038,845

[45] Date of Patent: Aug. 13, 1991

[54] BLOW TUBE ARRANGEMENT FOR CORE AND MOLD MAKING MACHINERY

[75] Inventor: Albert D. Kluge, Lansing, Mich.

[73] Assignee: Roberts Sinto Corporation, Lansing, Mich.

[21] Appl. No.: 576,596

[22] Filed: Aug. 31, 1990

[51] Int. Cl.[5] ..... B22C 15/24

[52] U.S. Cl. ..... 164/22; 164/21; 164/200; 164/201

[58] Field of Search ..... 164/21, 22, 20, 200, 164/201, 202

[56] References Cited

U.S. PATENT DOCUMENTS 3,235,921 2/1966 Bego et al. ..... 164/200
3,747,665 7/1973 Taburinsky et al. ..... 164/200
3,903,952 9/1975 Bego et al. ..... 164/22 X
4,129,160 12/1978 Lenglet ..... 164/200 X

FOREIGN PATENT DOCUMENTS 39-17503 8/1964 Japan ..... 164/200

*Primary Examiner*—J. Reed Batten, Jr.
*Attorney, Agent, or Firm*—John R. Benefiel

[57] ABSTRACT

A blow tube arrangement and method for controlling the flow of granular mold material to the cavity of a mold or core making machine, in which one or more transverse openings are formed in the tip of the blow tube, which allow flow into the cavity when the tip is inserted into the cavity but which are covered as the tip is withdrawn. A spring urged covering sleeve receives the tip as it is withdrawn from the mold pattern structure to maintain closure of the tip openings.

7 Claims, 3 Drawing Sheets

BLOW TUBE ARRANGEMENT FOR CORE AND MOLD MAKING MACHINERY

BACKGROUND OF THE INVENTION

This invention concerns mold and core making machines involving the use of air pressure to blow a granular mold material, such as resin coated sand, from a supply into a pattern structure such as a flask or core box. The resin coated sand is cured to form a mold or core for use in casting metals. Such resin coated sand is quite free flowing such that it will tend to continue to flow out of a supply box even after the air pressure is cut off.

The continued flow forms "candles" on the molds or cores which must be removed prior to their use.

U.S. Pat. No. 3,530,928 issued on Sept. 29, 1970 for a "Blow Head Having Valve Means Cooperating with Flexible Chamber Walls" describes a valving for resin coated sand intended to control this tendency for sand flow.

U.S. Pat. No. 2,761,186 issued on Sept. 4, 1956 for a "Blow Tube for Core Blowing Machine" also is concerned with solving this same problem.

The arrangements shown in these patents do act to cut off flow after the blow tube is withdrawn from the pattern, but do not prevent the formation of features from flow within the bores in the pattern wall into which the blow tube is inserted.

SUMMARY OF THE INVENTION

The present invention comprises an arrangement for achieving complete control over the flow of sand such as to totally eliminate undesired flow, even that which could occur as the blow tube is withdrawn from an entrance bore formed in a wall of the core box or other pattern structure.

This arrangement includes a blow tube having a series of transverse exit openings at the end thereof allowing mold material to be blown into the pattern cavity with the blow tube fully inserted into the pattern wall.

A surrounding covering sleeve is telescoped over the blow tube and spring urged so as to tend to slide over the transverse exit openings to block the same, the covering sleeve forced back as the blow tube enters the entrance bore in the pattern wall.

The blow tube is relatively closely fit to the entrance bore so as to block the exit openings upon entry of the blow tube thereinto.

As the blow tube is withdrawn, it passes into the sleeve which is maintained against the exterior of the pattern wall by the springs.

Thus, any escape of mold material outside of the pattern cavity is absolutely prevented to totally eliminate extraneous formations.

The covering sleeve is also provided with a cooling jacket through which a coolant is circulated to prevent overheating of the blow tube by conductance from the pattern structure.

DETAILED DESCRIPTION

In the following detailed description, certain specific terminology will be employed for the sake of clarity and a particular embodiment described in accordance with the requirements of 35 USC 112, but it is to be understood that the same is not intended to be limiting as the invention is capable of taking many forms and variations within the scope of the appended claims.

Figure 1:
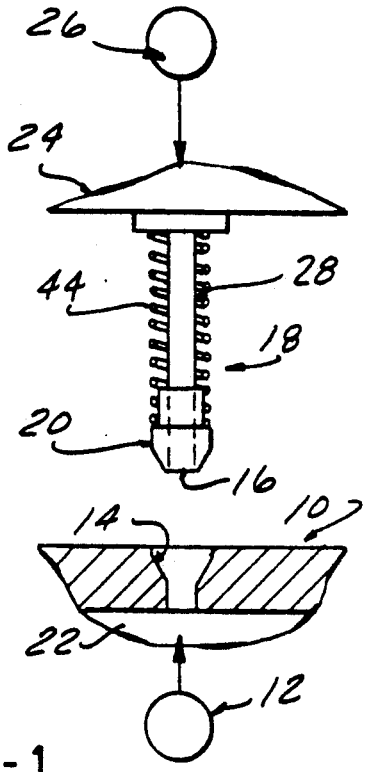
FIG. 1 is a diagrammatic fragmentary view of a mold making apparatus incorporating a blow tube arrangement according to the present invention.
Figure 3:
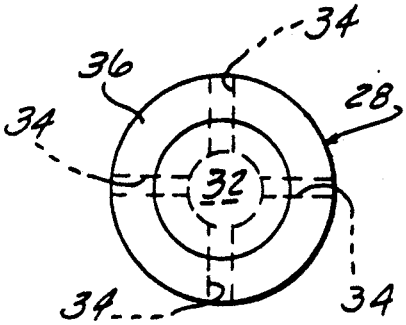
FIG. 3 is a further enlarged end view of the blow tube shown in FIG. 2.

Referring to the Drawings, FIG. 1 shows a mold or core pattern structure, such as a core box 10 which is elevated by a mechanism 12 to cause a chamfered entrance bore 14 to receive the aligned tip 16 of a blow tube assembly 18.

By continued operation of the mechanism 12, the tip 16 is thereby advanced completely through entrance bore 14 and into a cavity 22 so that a quantity of granular mold material may be blown thereinto from a sand tank 24, by the application of air pressure from a source 26.

Figure 2:
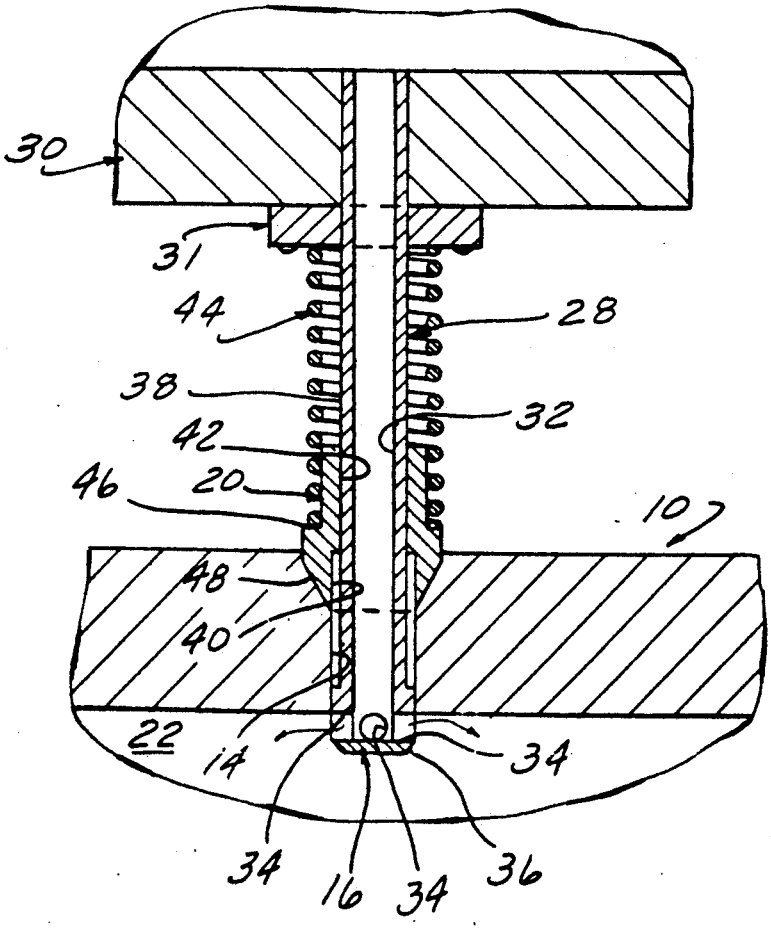
FIG. 2 is an enlarged sectional view of a blow tube arrangement together with fragmentary segments of a blow plate and core box wall, shown with the blow tube fully inserted into an entrance bore in the core box wall.

FIG. 2 shows the details of the various components of the blow tube assembly 18 and their relationship at the time of the injection of air into the cavity 22. The blow tube assembly 18 includes a blow tube 28 fixed to blow plate 30 as by a threaded connection and collar 31, the blow tube having a longitudinal central bore 32 extending to a series of transverse openings 34 radiating out from the central bore 32. The tip 16 is formed with a chamfer 36 to assist in entering the bore 14.

A covering sleeve 20 is slidably fit to be telescoped over the outside diameter of the blow tube 28 along the reduced diameter section 38 above the larger diameter tip 16.

The covering sleeve 20 is formed with a counterbore 40 of a larger diameter than the main bore 42, the counterbore sized to obtain a slidable fit with the larger diameter tip 16 of the blow tube 28.

A compression spring 44 is interposed between the collar 31 and a shoulder 46 formed on the covering sleeve 20 to urge the covering sleeve 20 to tend to be moved to cover the tip 16 of the blow tube 28.

The entrance bore 14 is formed with a tapering entrance section 14A which mates with a tapered lower end 48 of covering sleeve 20, the covering sleeve 20 held thereby in a retracted position.

Thus, in the position shown in FIG. 2, the tip 16 protrudes into the cavity 22, and the radiating transverse openings 34 are uncovered such that sand may be blown into the cavity 22.

As the pattern 10 is lowered, the tip 16 is withdrawn into the bore 14, covering the openings 34, immediately preventing any further flow of sand out of the blow tube 28.

Figure 5:
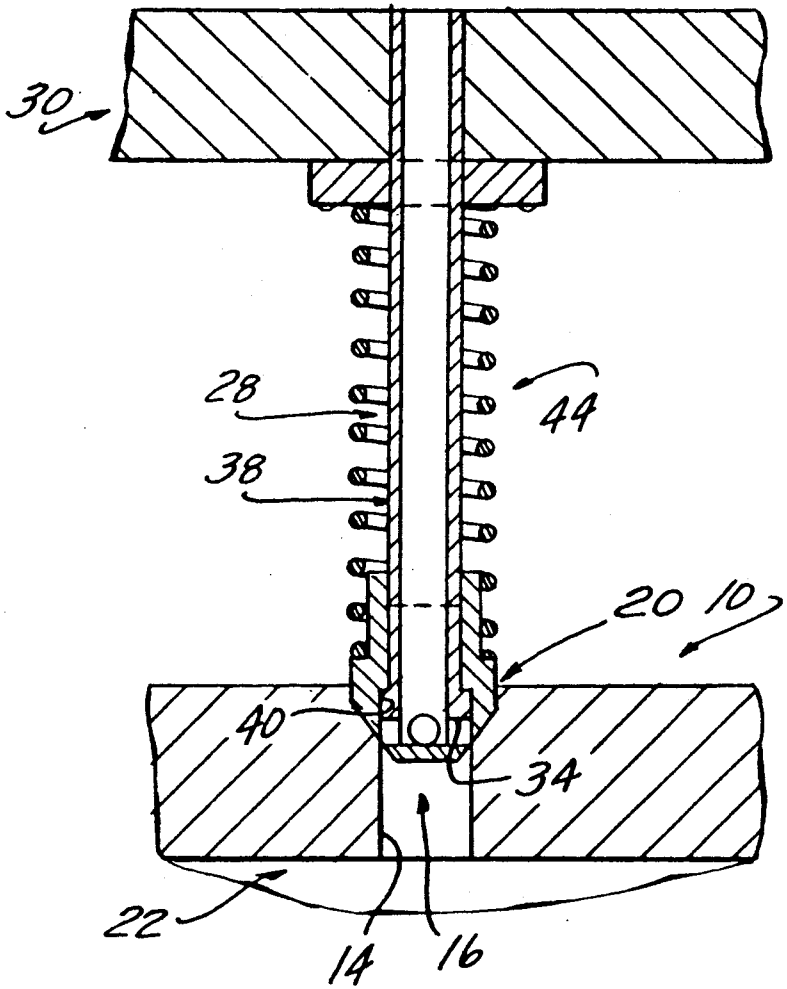
FIG. 5 is the same view as FIG. 4 with the blow tube withdrawn sufficiently so that the covering sleeve is seated.
Figure 4:
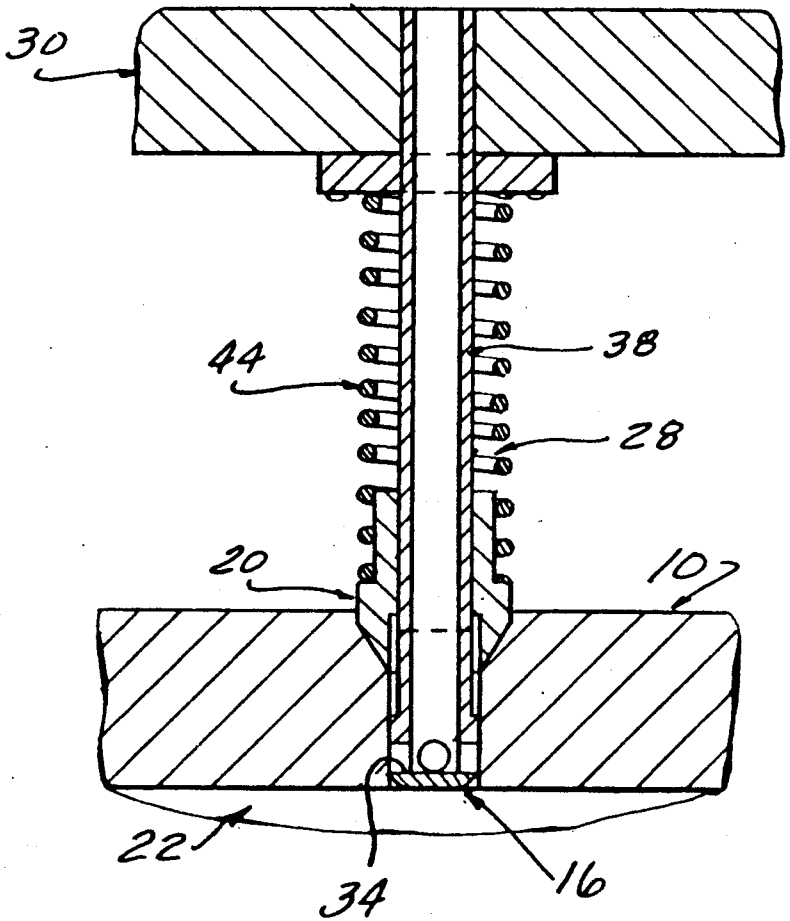
FIG. 4 is a sectional view of the blow tube arrangement shown in FIG. 2 with the blow tube withdrawn from the core box cavity and retracted into the entrance bore.
Figure 6:
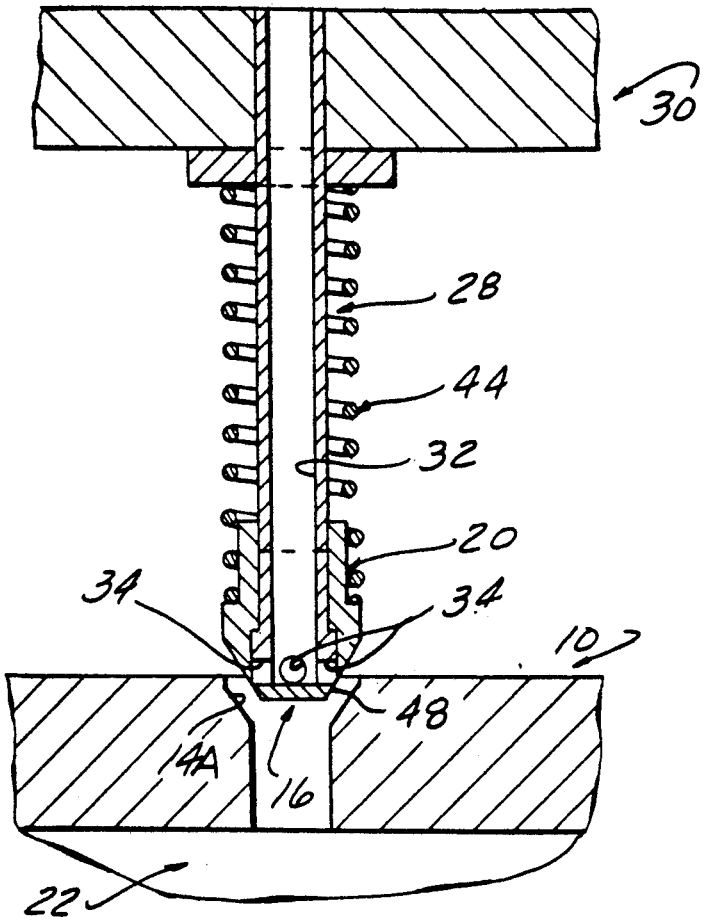
FIG. 6 is the same view as FIG. 5, showing the blow tube and cover sleeve retracted away from the core box wall.

The covering sleeve 20, in the meantime remains pressed against the pattern 10 under the urging of the compression spring 44 until the tip section reaches the end of the counterbore 40 as shown in FIG. 5. The openings 34 at this point have been completely covered by the tip 16 moving within the counterbore 40.

Thus, as the pattern 10 and blow plate 30 move apart, and the tip 16 moves completely out of the bore 14, the openings 34 are maintained completely covered.

Thus, no unintended escape of sand is possible, and formation of candles or other extraneous shapes completely avoided.

Figure 7:
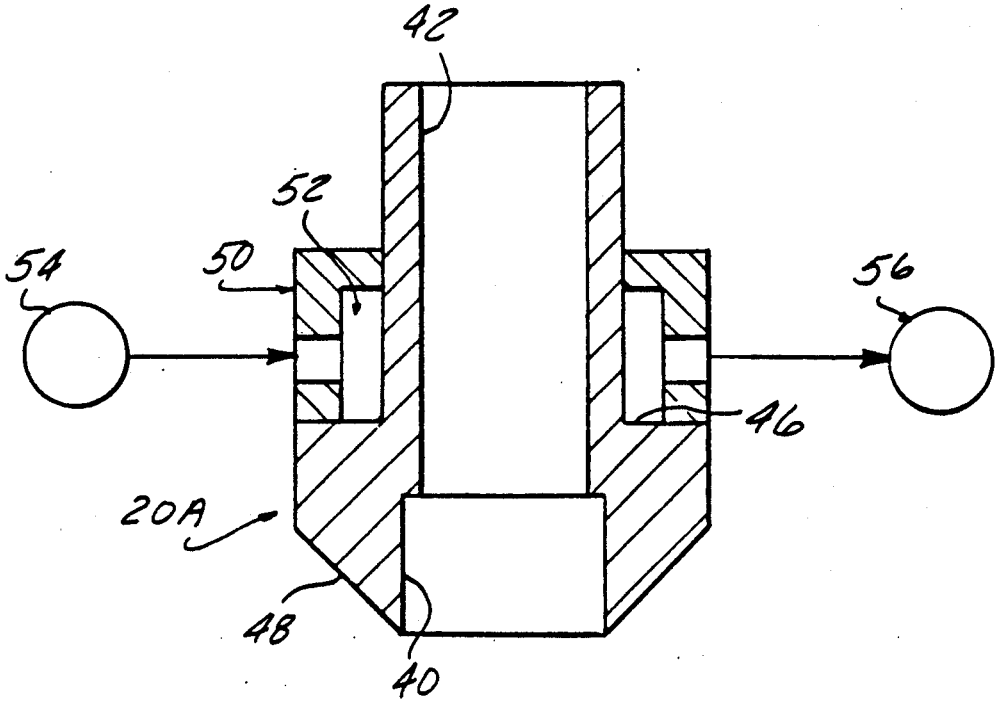
FIG. 7 is an enlarged sectional view of an alternate embodiment of the covering sleeve, incorporating a cooling jacket with a diagrammatic depiction of a coolant circulation system.

FIG. 7 illustrates an alternate form of covering sleeve 20A in which a jacket 50 is welded over the shoulder 46, forming an annular passage 52 which may be supplied with a coolant from a source 54 and flowing to a return to thereby achieve cooling of the blow tube and preventing unwanted curing of the resin coated sand.

I claim:

1. In combination with a core/mold pattern making machine, a blow tube arrangement for directing a flow of granular mold material into a cavity in a pattern structure included in said machine, through an entrance bore in said pattern structure, said blow tube arrangement comprising:

a blow tube having a tip portion slidably fit into said entrance bore; a longitudinal passage extending within said blow tube adapted to receive said flow of granular material; at least one transverse opening radiating from said longitudinal passage out of said tip portion to direct flow out of said tip portion in a radial direction; a covering sleeve slidably fit over said blow tube; spring bias means urging said sleeve to move towards said tip portion; said sleeve having a bore overlying said transverse opening with said sleeve positioned over said tip portion, whereby upon insertion of said tip portion into said entrance bore, said covering sleeve may be retracted against the force of said bias means to uncover said transverse opening as said blow tube tip portion passes into said entrance bore, said transverse opening remaining covered by said slidable fit of said tip portion in said entrance bore until said tip portion enters into said cavity.

2. The blow tube arrangement according claim 1 wherein said tip portion is of a larger diameter than the remaining main section of said blow tube, said bore of said covering sleeve slidably receiving said main section of said blow tube, said covering sleeve formed with a counterbore slidable over said tip portion of said blow tube when said covering sleeve is advanced.

3. The blow tube arrangement according to claim 1 wherein said entrance bore is formed with a tapering entry section and said covering sleeve is formed with a complementary taper at the end thereof.

4. The blow tube arrangement according to claim 2 wherein said spring bias means comprises a compression spring.

5. The blow tube arrangement according to claim 2 wherein the bottom of said counterbore in said covering sleeve abuts the transition between said main and tip portions of said blow tube with said covering sleeve covering said transverse opening.

6. The blow tube arrangement according to claim 1 wherein a series of four openings radiate out from said longitudinal passage at said tip portion of said blow tube.

7. A method of controlling the flow of sand from a blow tube having a tip and into a cavity formed in a pattern structure, the method including the steps of:

slidably fitting the blow tube into an entrance bore extending into said cavity;

forming at least one transverse opening in said blow tube radiating out from a longitudinal passage in said blow tube, said transverse opening located at the tip so as to enter said cavity and allow a radial flow of granular mold material into said cavity, said transverse opening covered upon withdrawal of said tip into said entrance bore;

slidably mounting a covering sleeve on said blow tube out of said pattern structure and receiving said blow tube into said covering sleeve as said blow tube is withdrawn so as to maintain coverage of said transverse opening as said blow tube tip is withdrawn from said entrance bore, whereby maintaining coverage of said at least one transverse opening except when said tip is within said cavity.

* * * * *